US010921087B2

(12) United States Patent
Rentz et al.

(10) Patent No.: US 10,921,087 B2
(45) Date of Patent: Feb. 16, 2021

(54) DOUBLE LOCK CONNECTOR

(71) Applicant: Gregory E. Summers, Madison Heights, VA (US)

(72) Inventors: Marc T. Rentz, Madison Heights, VA (US); Gregory E. Summers, Amherst, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 16/421,589

(22) Filed: May 24, 2019

(65) Prior Publication Data

US 2020/0370858 A1 Nov. 26, 2020

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/14; F41B 5/1426; F41C 11/10; Y10T 403/32262; Y10T 403/32368
USPC ..... 124/86, 88, 89; 403/84, 97, 98, 103
See application file for complete search history.

(56) References Cited

U.S. PATENT DOCUMENTS 3,342,172 A * 9/1967 Dewitt ..... F41B 5/1426 124/23.1
3,419,295 A * 12/1968 Small ..... F16C 11/10 403/92
4,054,121 A * 10/1977 Hoyt, Jr. ..... F41B 5/1426 124/89
4,553,522 A * 11/1985 Topping ..... F41B 5/1426 124/89
4,917,343 A * 4/1990 Wainscott ..... A47B 23/06 248/284.1
5,239,977 A * 8/1993 Thomas ..... F41B 5/1426 124/88
5,630,407 A * 5/1997 Gasser ..... F41B 5/1426 124/89
5,934,266 A * 8/1999 Martin ..... F41B 5/1426 124/88
5,992,403 A * 11/1999 Slates ..... F41B 5/1426 124/89
6,205,992 B1 * 3/2001 Meeks ..... F41B 5/14 124/86
(Continued)

*Primary Examiner* — Alexander R Niconovich
(74) *Attorney, Agent, or Firm* — Leading Edge Law Group, PLC

(57) ABSTRACT

A double locking connector includes a base having a tapered end portion and a fitting having a chamber configured to receive the tapered end portion. Two independent locking assemblies are provided to connect the fitting with the base tapered portion to provide a secure connection. The first locking assembly includes a screw which passes through an opening in the fitting for connection with a threaded opening in the tapered portion. The second locking assembly includes a locking pin arranged in a channel in the fitting and a screw which is operable to draw the locking pin against a portion of the tapered portion. The tapered portion preferably includes three symmetrical contact surfaces which engage an inner surface of the fitting chamber to evenly distribute clamping forces from the fitting onto the tapered portion when the first locking assembly is operated.

8 Claims, 5 Drawing Sheets

(56) References Cited

U.S. PATENT DOCUMENTS 6,216,317 B1 * 4/2001 Chen ..... B25G 1/063 16/430
6,957,648 B1 * 10/2005 Adcock ..... F41B 5/1426 124/86
7,367,740 B2 * 5/2008 Lazic ..... F16C 11/10 248/125.1
7,434,773 B1 * 10/2008 Minjares ..... F41A 23/06 124/86
7,958,881 B2 * 6/2011 Silverson ..... F41B 5/1426 124/86
8,347,870 B1 * 1/2013 Mahutga ..... F41B 5/1426 124/89
8,646,440 B1 * 2/2014 Albanese ..... F41B 5/1426 124/88
8,701,645 B2 * 4/2014 Stokes ..... F41B 5/1426 124/89
8,776,772 B1 * 7/2014 Albanese ..... F41B 5/1426 124/88
8,839,774 B1 * 9/2014 Torbett ..... F41B 5/1453 124/88
8,869,785 B2 * 10/2014 Bidigare ..... F41B 5/1426 124/89
8,955,504 B1 * 2/2015 Albanese ..... F41B 5/1426 124/88
9,032,947 B2 * 5/2015 Bidigare ..... F41B 5/1426 124/89
9,038,617 B1 * 5/2015 Khoshnood ..... F41B 5/1426 124/89
9,377,269 B2 * 6/2016 Bidigare ..... F41B 5/10
9,377,270 B2 * 6/2016 Stokes ..... F41B 5/1426
9,429,383 B2 * 8/2016 Martens ..... F41B 5/1426
10,240,886 B1 * 3/2019 Huang ..... F41B 5/1426
10,612,881 B2 * 4/2020 Houle ..... F41B 5/066
2012/0263519 A1 * 10/2012 Kotula ..... B25J 18/00 403/84
2013/0291846 A1 * 11/2013 Arndt ..... F41B 5/1453 124/23.1
2015/0184973 A1 * 7/2015 Martens ..... F41B 5/00 124/23.1
2019/0025009 A1 * 1/2019 Carpenter ..... F41B 5/1426

* cited by examiner

DOUBLE LOCK CONNECTOR

BACKGROUND OF THE DISCLOSURE

Professional archers often use a stabilizer with their bow to improve their accuracy. Similarly, hunters may also use a stabilizer as well. A stabilizer is typically screwed into an accessory hole on the bow, whether it by a compound or an Olympic bow. The stabilizer resists torque and absorbs vibrations in the bow when shot, thereby reducing the shock felt in the archer's hand on the bow grip. It also helps keep the bow balanced and settles the archer's arm during aiming.

As a result of the vibrations in the bow, it is not uncommon for stabilizers to come loose and partially disconnect or unscrew from the bow. Not only does this diminish the effectiveness of the stabilizer, but the time and effort required to repeatedly tighten the stabilizer on the bow becomes frustrating to an archer and can distract the archer's concentration.

BRIEF DESCRIPTION OF THE PRIOR ART

In order to improve the connection between a stabilizer and a bow, most stabilizer connectors currently in use include a male and female assembly connection design to lock the stabilizer bar down to the archer's preferred angular position relative to the bow. While current stabilizer connectors operate satisfactorily, the vibrations from the bow still tend to weaken the male/female connector to such an extent that the stabilizer shifts from its preferred angular position.

SUMMARY OF THE INVENTION

The present disclosure describes an improved stabilizer connector which provides greater strength to keep the stabilizer from moving from the preferred position. The connector includes a base having a tapered end portion which is preferably in the shape of a truncated cone. A fitting is also provided which includes a chamber configured to receive the base tapered end portion. A locking assembly clamps the fitting onto the tapered end portion.

In one embodiment, the tapered end portion contains three symmetrical contact surfaces and a threaded opening in the end surface and the locking assembly includes a screw which passes through an opening in the fitting and into the threaded opening of the tapered end of the base. Tightening of the screw clamps the fitting onto the base tapered end portion.

In another embodiment, a second locking assembly is provided for connecting the fitting with the base tapered end portion independent of the first locking assembly. The second locking assembly includes a locking pin having a first end portion which engages an outer surface of the base tapered end portion and a second end portion which is arranged in a channel in the fitting which extends parallel to the axis of the fitting. The end surface of the second end portion of the locking pin includes a threaded opening. A second screw is arranged in the fitting channel and is threadably connected with the threaded opening of the locking pin. When the second screw is rotated in the locking direction, the locking pin first end portion is pressed against the base tapered end portion outer surface and a surface of the fitting which defines the fitting chamber is pressed against the base tapered end portion outer surface.

The base tapered end portion contains an annular recess in its outer surface in a region of the tapered end portion remote from the tapered end portion end surface. The locking pin first portion is pressed into the annular recess when the second screw is rotated in the locking direction.

BRIEF DESCRIPTION OF THE FIGURES

Other objects and advantages of the connector will become apparent from a study of the following specification when viewed in the light of the accompanying drawing, in which.

DETAILED DESCRIPTION

Figure 1:
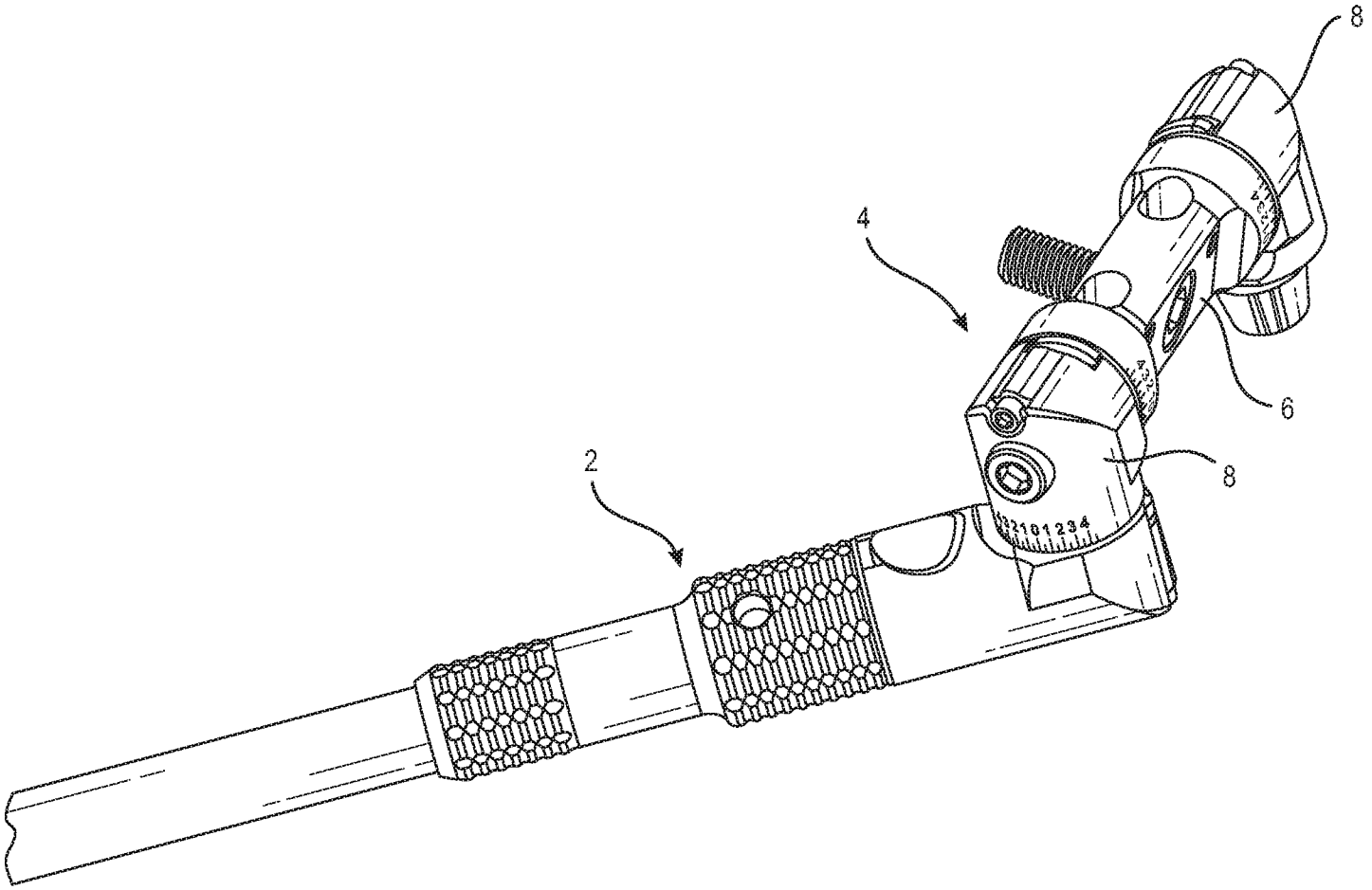
FIG. 1 is a front perspective view of a first embodiment of a connector for an archery bow stabilizer.

In FIG. 1 is shown a stabilizer 2 for an archery bow and a connector 4 for connecting the stabilizer to the bow (now shown). The connector 4 is actually a dual connector. That is, it includes a base 6 with a fitting 8 mounted on each end of the base.

Figure 2:
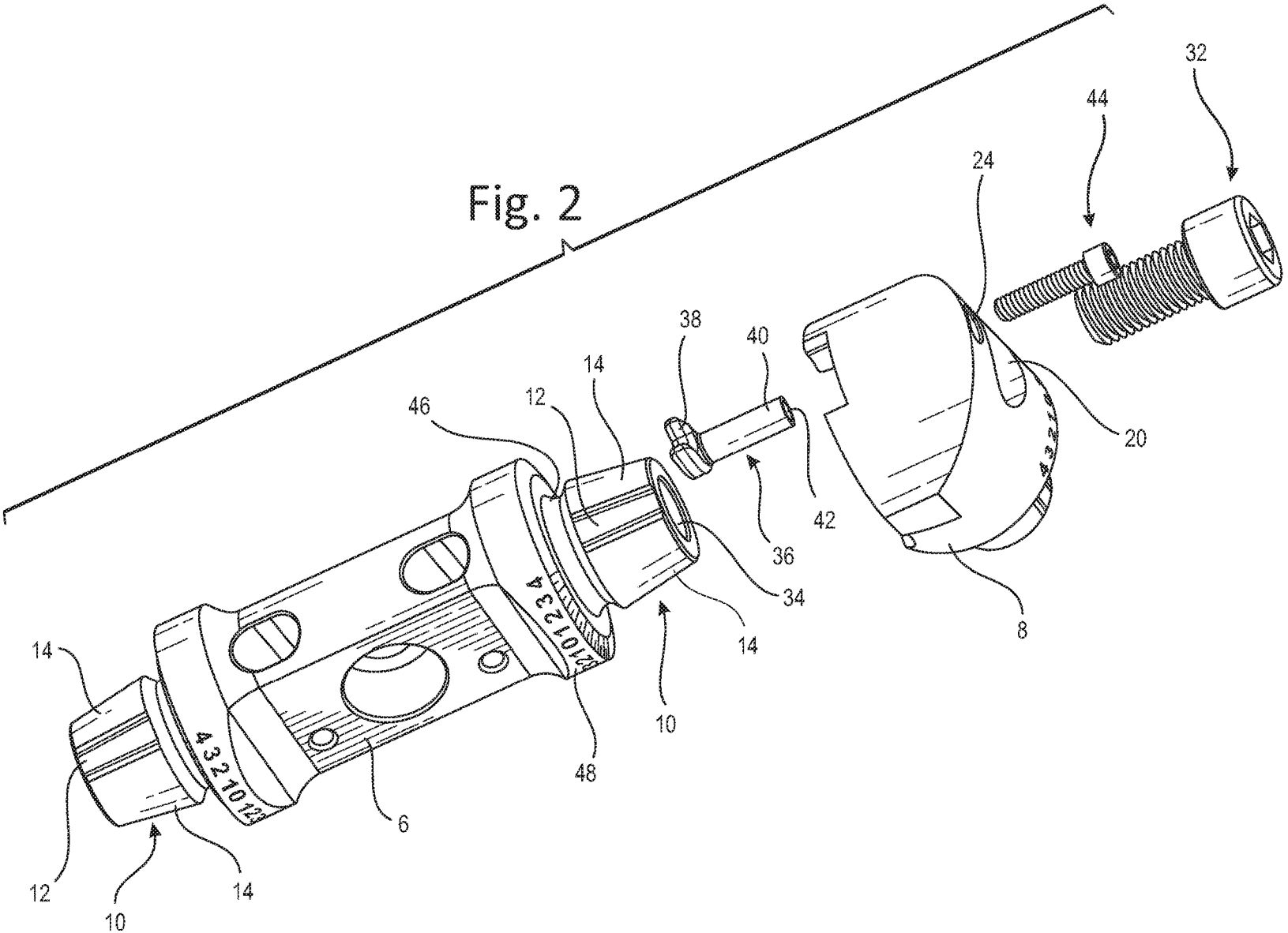
FIG. 2 is an exploded perspective view of the connector of FIG. 1.

The components for the connector are shown in more detail in FIGS. 2-5. Referring first to FIG. 2, the base 6 is shown with an elongated configuration having tapered end portions 10. It will be readily appreciated by those of ordinary skill in the art that the base may have other configurations, for example an L-shaped configuration, and may have any number of tapered portions at various locations on the base. The tapered portions are generally in the form of a truncated cone. As will be developed in greater detail below, the outer surface of each tapered portion contains an elongated recess 12 which extends parallel to the axis of the tapered portion and preferably from end-to-end within the outer surface. Preferably, a plurality of recesses is provided in each tapered end, the recesses being equally radially spaced around the circumference of the tapered end. According to a preferred embodiment, three recesses are provided, each spaced by 120°. The recesses thus define contact surfaces 14 for each tapered end portion. The contact surfaces are preferably smooth and flat.

Figure 4:
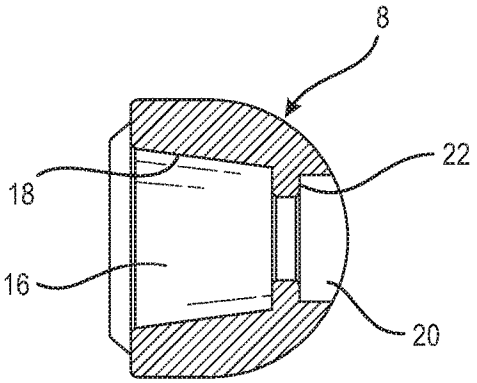
FIG. 4 is a sectional view of the fitting of FIG. 3 taken along line 4-4.
Figure 3:
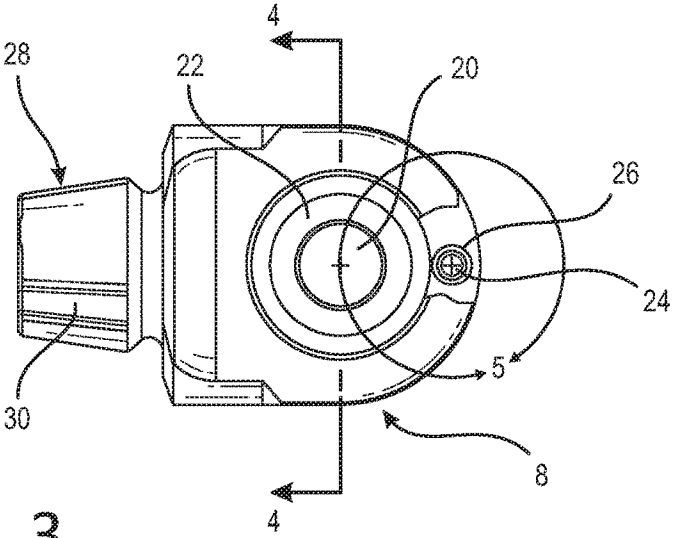
FIG. 3 is a bottom view of a fitting of the connector.
Figure 5:
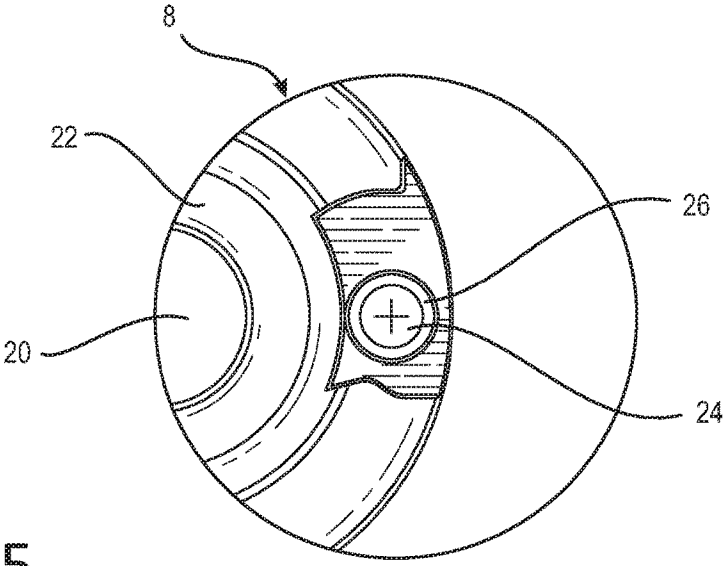
FIG. 5 is an enlarged view of a portion of the fitting of FIG. 3 taken along line 5-5.

The connector fitting 8 is shown in more detail in FIGS. 3-5. Each fitting contains a chamber 16 for receiving a tapered end portion of the base. As shown in FIG. 4, the chamber is defined by an inner surface 18 of the fitting which is configured with the same taper as the tapered end portion 10 of the base. A through opening 20 is provided in each fitting along an axis of the chamber as shown in FIGS. 3 and 4. A recessed seat 22 is provided in the fitting surrounding the through opening. A channel 24 is also provided in each fitting. The channel extends parallel to the through opening. A recessed seat 26 is provided in the fitting surrounding the channel. A tapered extension 28 may also be provided on the fitting for connection with another archery component (not shown) if desired. The extension also contains one or more recesses 30 in the outer surface thereof, the recesses preferably extending continuously from end-to-end of the extension.

A first locking assembly connects the fitting with the base. More particularly, the first locking assembly includes a threaded screw 32 which passes through the first through opening 20 of the fitting. The head of the screw rests against the seat 22. The tapered end portion 10 of the base includes a threaded opening 34 (FIG. 2) which receives the screw 32. Rotation of the screw 32 in a locking direction clamps the fitting onto the tapered end portion as will be discussed below.

In order to further clamp the fitting 8 on the tapered end portion 10 of the base of the connector, a second locking assembly is provided. The second locking assembly is independent of the first locking assembly. It includes a locking pin 36 having a first end portion 38 which engages the outer surface of the tapered end portion and a second end portion 40 which is arranged in the fitting channel 24. The end surface of the locking pin second end portion contains a threaded opening 42. The second locking assembly includes a threaded screw 44 which passes into the fitting channel for connection with the threaded opening 42 of the locking pin 36.

As shown in FIG. 2, each tapered end portion 10 of the base contains an annular recess 46 in a region remote from the tapered end portion end surface. The first portion 38 of the locking pin 36 is pressed into the annular recess when the second screw is rotated in the locking direction.

The assembly of the connector will be described with reference to FIGS. 6*a*, 6*b*, 7*a*, and 7*b*. The locking pin 36 is arranged in the channel 24 of the fitting 8 and the screw 44 is loosely connected with the pin to retain it in the fitting. The fitting is placed over the tapered end portion 10 of the base with the lock pin toggled to a position where the first portion 38 of the lock pin disengaged from the annular recess 46. More particularly, the radius of the lock portion first pin varies to provide clearance from the widest portion of the tapered portion during insertion of the tapered portion into the fitting chamber as shown in FIGS. 6*a* and 6*b*.

Figure 6B:
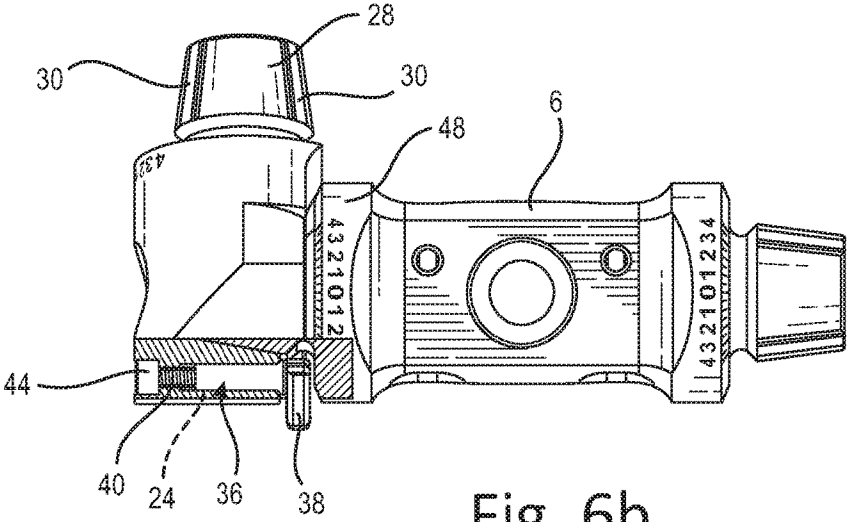
FIGS. 6*a* and 6*b* are a partially cutaway end view and a partially cutaway side view, respectively, of the connector of FIG. 2 showing a locking pin in an unlocked position for disassembly of the connector.
Figure 7B:
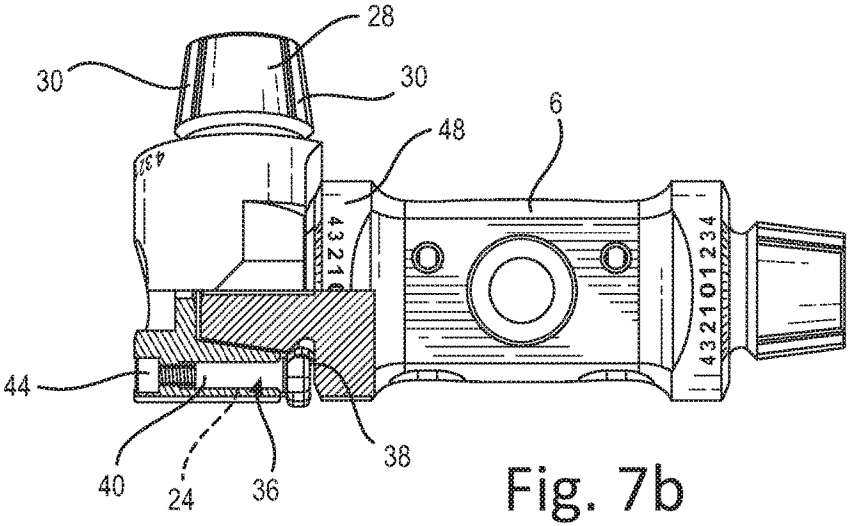
FIGS. 7*a* and 7*b* are a partially cutaway end view and a partially cutaway side view, respectively, of the connector of FIG. 2 showing the locking pin in a locked position.
Figure 6A:
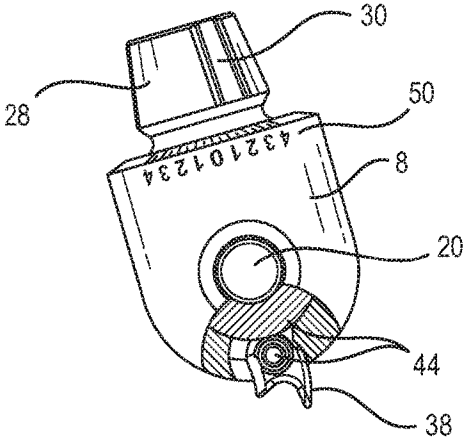
Figure 7A:
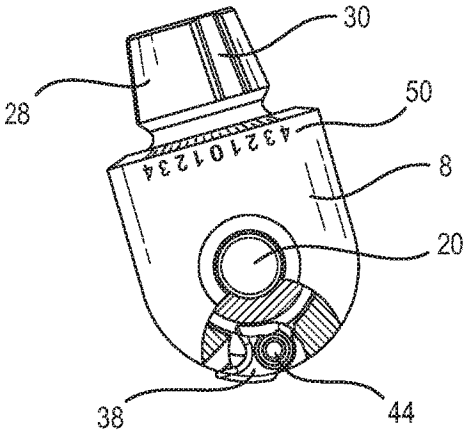

With the fitting loosely mounted on the base tapered end portion as shown in FIGS. 6*a* and 6*b*, the fitting may be rotated relative to the base to control the positioning of an accessory such as a stabilizer for a bow to meet the preferences of the archer. A scale 48 is provided on the base to assist with positioning of the fitting. Similarly, a scale 50 is provided on the fitting where the fitting also is provided with a tapered portion 28. With the fitting properly oriented on the base, the locking pin is toggled to insert the first portion 38 of the locking pin into the annular recess of the base tapered end portion as shown in FIGS. 7*a* and 7*b*. The screw 44 is rotated in the locking direction. Because the head of the screw abuts against the seat 26 surrounding the end of the channel 24, the locking pin is drawn toward the screw so that the first portion 38 of the locking pin presses against the surface of the annular recess of the tapered end portion.

Figure 8A:
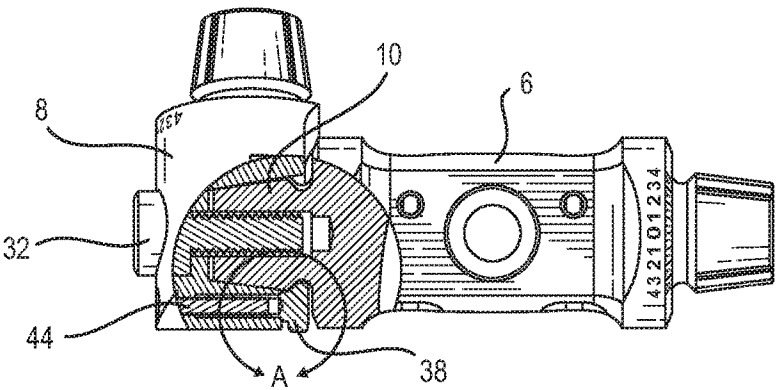
FIG. 8*a* is a partially cutaway side view of the connector of FIG. 2 in the locked position.
Figure 8B:
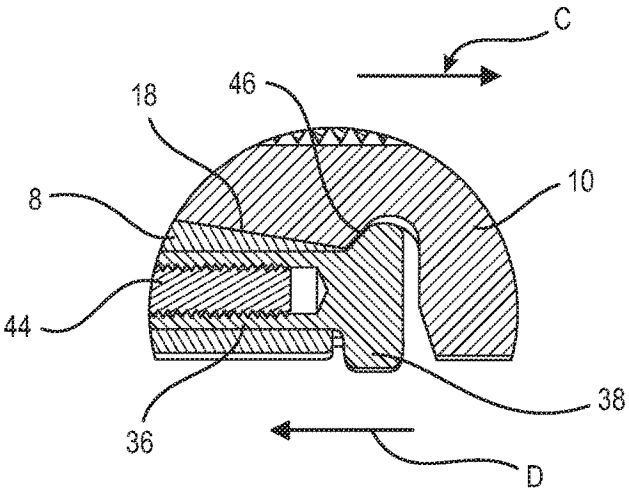
FIG. 8*b* is a detailed view of a portion of FIG. 8*a* taken along line A-A of FIG. 8*a;*

To complete the assembly of the connector, the screw 32 of the first locking assembly is inserted through the opening 20 in the fitting and connected with the threaded opening 34 of the tapered end portion 8 as shown in FIGS. 8*a* and 8*b*. As the screw 32 is rotated in the locking direction, the fitting is pressed against the tapered end portion of the base. More particularly, the inner wall surface 18 of the fitting chamber is pressed against the contact surfaces 14 of the tapered end portion 8 as shown by the arrow C. Where three contact surfaces are provided, the locking forces are evenly distributed about the tapered end portion. In addition to the locking operation of the screw 32 of the first locking assembly, the screw 44 of the second locking assembly when rotated in the locking direction draws the locking pin in the direction shown by the arrow D to further engage the first end portion 38 of the locking pin against the surface defining the annular recess 46 of the tapered end portion. Accordingly two locking forces in opposite directions are provided for a double lock connection between the base and the fitting owing to the first and second locking assemblies. This provides a superior connection in the connector assembly.

Figure 9A:
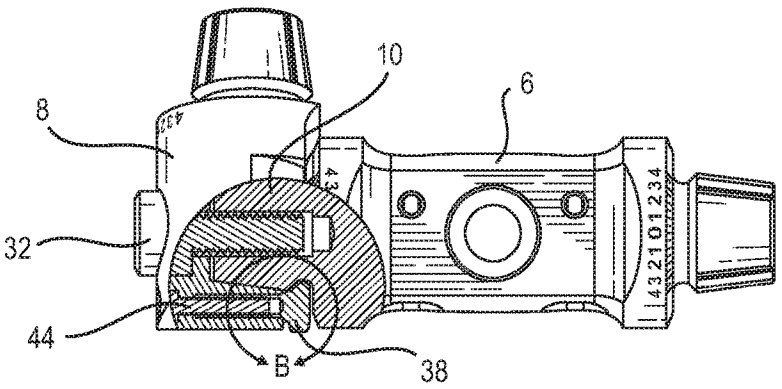
FIG. 9*a* is a partially cutaway side view of the connector of FIG. 2 in the locked position.
Figure 9B:
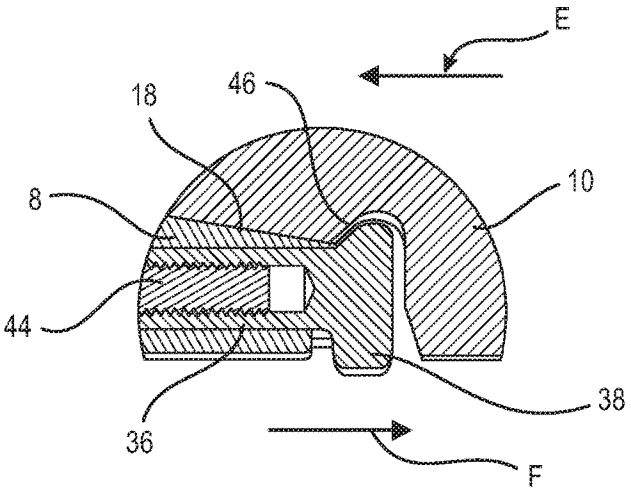
FIG. 9*b* is a detailed view of a portion of FIG. 9*a* taken along line B-B of FIG. 9*a*.

The unlocked condition of the connector is shown in FIGS. 9*a* and 9*b*. When the locking screw 32 is rotated in the unlocking direction, the fitting moves in the direction of the arrow E of FIG. 9*b* to disengage the fitting inner surface 18 from the contact surfaces 14 of the tapered end portion. Similarly, when the screw 44 is rotated in the unlocking direction, the locking pin 36 moves in the direction of the arrow F of FIG. 9*b* to disengage the first portion 38 of the locking pin from the surface of the annular recess 46.

While the preferred forms and embodiments of the archery stabilizer tube have been illustrated and described, it will be apparent to those of ordinary skill in the art that various changes and modifications may be made without deviating from the novel concepts thereof.

What is claimed is:

1. A connector, comprising (a) a base having an end portion having a conical configuration and a radially smooth contact surface;

(b) a fitting containing a chamber configured to receive said base end portion;

(c) a first locking assembly for connecting said fitting with said base end portion; and (d) a second locking assembly for connecting said fitting with said base end portion independent of said first locking portion.

2. A connector as defined in claim 1, wherein said base end portion contains a threaded opening in an end surface thereof, said first locking assembly including a first screw which passes through an opening in said fitting and is connected with said threaded opening.

3. A connector as defined in claim 2, wherein said fitting contains a channel having an axis which extends parallel to an axis of said base and said second locking assembly includes (a) a locking pin having a first end portion which engages an outer surface of said base end portion and a second end portion which is arranged in said fitting channel, said second end portion containing a threaded opening in an end surface thereof; and (b) a second screw which is arranged in said fitting channel and is threadably connected with said threaded opening of said locking pin, whereby when said second screw is rotated in a locking direction, said locking pin first end portion is pressed against said base end portion radially smooth contact surface and a surface of said fitting which defines said fitting chamber is pressed against said base end portion radially smooth contact surface.

4. A connector as defined in claim 3, wherein said base end portion contains an annular recess in a region of said base end portion remote from said base end portion end surface, said locking pin first portion being pressed into said annular recess when said second screw is rotated in said locking direction.

5. A connector as defined in claim 1, wherein said radially smooth contact surface comprises a flattened surface extending from a free end of said base end portion toward said base.

6. A connector as defined in claim 5, wherein said base end portion contains three flattened surfaces spaced equally about a perimeter of said base end portion, thereby to define three contact surfaces of said base end portion within said fitting chamber for mating with a surface of said fitting which defines said fitting chamber.

7. A connector, comprising (a) a base having an end portion having a conical configuration, an outer surface of said base end portion containing three symmetrically radially smooth contact surfaces;

(b) a fitting containing a chamber configured to receive said base end portion; and (c) a locking assembly for clamping said fitting onto said radially smooth contact surfaces.

8. A connector as defined in claim 7, wherein said base end portion contains a threaded opening in an end surface thereof, said locking assembly including a screw which passes through an opening in said fitting for connection with said threaded opening.

* * * * *